US010891900B2

(12) United States Patent
Kim et al.

(10) Patent No.: US 10,891,900 B2
(45) Date of Patent: Jan. 12, 2021

(54) EMISSION DRIVER AND ORGANIC LIGHT EMITTING DISPLAY DEVICE HAVING THE SAME

(71) Applicant: Samsung Display Co., Ltd., Yongin-si (KR)

(72) Inventors: Hyun Woong Kim, Yongin-si (KR); Seung Kyu Lee, Yongin-si (KR); Won Mi Hwang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/369,740

(22) Filed: Mar. 29, 2019

(65) Prior Publication Data

US 2019/0304375 A1 Oct. 3, 2019

(30) Foreign Application Priority Data

Mar. 29, 2018 (KR) ..... 10-2018-0036859

(51) Int. Cl.
*G09G 3/3258* (2016.01)

(52) U.S. Cl.
CPC ..... *G09G 3/3258* (2013.01)

(58) Field of Classification Search
CPC .. G09G 3/3258; G09G 3/3266; G09G 3/3208; G09G 2310/0286
See application file for complete search history.

(56) References Cited

U.S. PATENT DOCUMENTS 8,306,177 B2 11/2012 Lee et al.
9,548,026 B2 1/2017 Jang
2009/0309868 A1 12/2009 Jung et al.
2012/0188290 A1* 7/2012 Park ..... G09G 3/3266 345/690
2016/0035262 A1* 2/2016 Lee ..... G09G 3/3266 345/690
2017/0365211 A1 12/2017 Lee et al.
2018/0286314 A1 10/2018 Cho et al.

FOREIGN PATENT DOCUMENTS

KR 10-2014-0025149 A 3/2014
KR 10-1472799 B1 12/2014
KR 10-1579082 B1 12/2015
KR 10-2017-0143052 A 12/2017
KR 10-2018-0112193 A 10/2018

* cited by examiner

*Primary Examiner* — Kent W Chang
*Assistant Examiner* — Andrew Lee
(74) *Attorney, Agent, or Firm* — Kile Park Reed & Houtteman PLLC

(57) ABSTRACT

An emission driver according to example embodiments includes a plurality of stages each having an input block; an output block; a first signal processing block controlling a voltage of a first node; a second signal processing block controlling a voltage of a fourth node in response to the signal supplied to a third input terminal and a voltage of a fifth node; a third signal processing block controlling the voltage of the fourth node; a fourth signal processing block controlling the voltage of the third node; and a stabilization block electrically connected between the input block and the output block to limit a voltage drop between the first node and the third node. The stabilization block may limit a voltage drop between a second node and the fourth node by lowering a voltage of a second power source to the fifth node.

20 Claims, 6 Drawing Sheets

EMISSION DRIVER AND ORGANIC LIGHT EMITTING DISPLAY DEVICE HAVING THE SAME

CROSS REFERENCE TO RELATED APPLICATION

Korean Patent Application No. 10-2018-0036859, filed on Mar. 29, 2018 in the Korean Intellectual Property Office (KIPO), and entitled: "Emission Driver and Organic Light Emitting Display Device Having the Same," is incorporated by reference herein in its entirety.

BACKGROUND

1. Field

Example embodiments relate to display devices. More particularly, example embodiments relate to emission drivers outputting emission control signals and organic light emitting display devices having the same.

2. Discussion of the Related Art

An organic light emitting display device includes a data driver for supplying a data signal to data lines, a scan driver for supplying a scan signal to the scan lines, an emission driver for supplying an emission control signal to the emission control line, and pixels arranged to be connected to the lines and the emission control lines.

An emission time of the pixels is controlled by the emission control signal supplied from the emission driver. The emission driver includes a stage connected to each of the emission control lines. The stage generates the emission control signal in response to a plurality of clock signals. When the emission control signal is unstable, the pixel may emit light at an undesired time. Therefore, a stage with stable output of the emission control signal is required.

SUMMARY

According to example embodiments, an emission driver may include a plurality of stages each outputting an emission control signal. A k-th stage may include an input block supplying a signal supplied to a first input terminal to a first node and supplying a voltage of a first power source to a second node, in response to a signal supplied to a second input terminal; an output block supplying the voltage of the first power source or a voltage of a second power source to an output terminal in response to a voltage of a third node and a voltage of a fourth node; a first signal processing block controlling a voltage of the first node in response to a voltage of the second node and a signal supplied to a third input terminal; a second signal processing block connected to a fifth node electrically connecting the second node and the fourth node, wherein the second signal processing block controls the voltage of the fourth node in response to the signal supplied to the third input terminal and a voltage of the fifth node; a third signal processing block controlling the voltage of the fourth node in response to the voltage of the first node; a fourth signal processing block controlling the voltage of the third node in response to the voltage of the fourth node; and a stabilization block electrically connected between the input block and the output block to limit a voltage drop between the first node and the third node. The stabilization block may limit a voltage drop between the second node and the fourth node by lowering the voltage of the second power source supplied to the fifth node.

In example embodiments, the stabilization block may include a first transistor connected between the second node and the fifth node, and including a gate electrode to receive the voltage of the first power source; a second transistor connected between the first node and the third node, and including a gate electrode to receive the voltage of the first power source; and a first capacitor connected between the second power source and the fifth node.

In example embodiments, the second signal processing block may include a third transistor connected between the third input terminal and a sixth node, and including a gate electrode connected to the fifth node; a fourth transistor connected between the sixth node and fourth node, and including a gate electrode connected to the third input terminal; and a second capacitor connected between the fifth node and the sixth node.

In example embodiments, a bias of a drain-source voltage of the first transistor may be determined based on a capacitance ratio between the first capacitor and the second capacitor.

In example embodiments, the first and second transistors may maintain a turn-on state regardless of the signals supplied to the first to third input terminals.

In example embodiments, the voltage of the first power source may correspond to a gate-on voltage and the voltage of the second power source corresponds to a gate-off voltage.

In example embodiments, the first input terminal may receive a start pulse or an output signal of a previous stage.

In example embodiments, the second input terminal may receive a first clock signal and the third input terminal receives a second clock signal.

In example embodiments, the first clock signal and the second clock signal may have a same period and the second clock signal may be a signal shifted by half a period from the first clock signal.

In example embodiments, the input block may include a fifth transistor connected between the first input terminal and the first node, and including a gate electrode connected to the second input terminal; a sixth transistor connected between the second input terminal and the second node, and including a gate electrode connected to the first node; and a seventh transistor connected between the first power source and the second node, and including a gate electrode connected to the second input terminal.

In example embodiments, the output block may include an eighth transistor connected between the first power source and the output terminal, and including a gate electrode connected to the third node; and a ninth transistor connected between the second power source and the output terminal, and including a gate electrode connected to the fourth node.

In example embodiments, the first signal processing block may include tenth and eleventh transistors connected in series between the second power source and the first node. A gate electrode of the tenth transistor may be connected to the second node and a gate electrode of the eleventh transistor is connected to the third input terminal.

In example embodiments, the third signal processing block may include a twelfth transistor connected between the second power source and the fourth node, and including a gate electrode connected to the first node or the third node; and a third capacitor connected between the second power source and the fourth node.

In example embodiments, the fourth signal processing block may include a thirteenth transistor connected between the second power source and a seventh node, and including a gate electrode connected to the fourth node; a fourteenth transistor connected between the seventh node and the third input terminal, and including a gate electrode connected to the third node; and a fourth capacitor connected between the seventh node and the third node.

According to example embodiments, an organic light emitting display device may include a display panel including a plurality of pixels; a scan driver supplying a scan signal to the pixels through a plurality of scan lines; an emission driver supplying an emission control signal to the pixels through a plurality of emission control lines; and a data driver supplying a data signal to the pixels through a plurality of data lines. The emission driver may include a plurality of stages each outputting the emission control signal. A k-th stage may include an input block supplying a signal supplied to a first input terminal to a first node and supplying a voltage of a first power source to a second node, in response to a signal supplied to a second input terminal; an output block supplying the voltage of the first power source or a voltage of a second power source to an output terminal in response to a voltage of a third node and a voltage of a fourth node; a first signal processing block controlling a voltage of the first node in response to a voltage of the second node and a signal supplied to a third input terminal; a second signal processing block connected to a fifth node electrically connecting the second node and the fourth node, wherein the second signal processing block controls the voltage of the fourth node in response to the signal supplied to the third input terminal and a voltage of the fifth node; a third signal processing block controlling the voltage of the fourth node in response to the voltage of the first node; a fourth signal processing block controlling the voltage of the third node in response to the voltage of the fourth node; and a stabilization block electrically connected between the input block and the output block to limit a voltage drop between the first node and the third node. The stabilization block may limit a voltage drop between the second node and the fourth node by lowering the voltage of the second power source supplied to the fifth node.

In example embodiments, the stabilization block may include a first transistor connected between the second node and the fifth node, and including a gate electrode to receive the voltage of the first power source; a second transistor connected between the first node and the third node, and including a gate electrode to receive the voltage of the first power source; and a first capacitor connected between the second power source and the fifth node.

In example embodiments, the second signal processing block may include a third transistor connected between the third input terminal and a sixth node, and including a gate electrode connected to the fifth node; a fourth transistor connected between the sixth node and fourth node, and including a gate electrode connected to the third input terminal; and a second capacitor connected between the fifth node and the sixth node.

In example embodiments, a bias of a drain-source voltage of the first transistor may be determined based on a capacitance ratio between the first capacitor and the second capacitor.

In example embodiments, the first input terminal may receive a start pulse or an output signal of a previous stage.

In example embodiments, the second input terminal and the third input terminal of a j-th stage may receive a first clock signal and a second clock signal, respectively. The second input terminal and the third input terminal of a (j+1)-th stage may receive the second clock signal and the first clock signal, respectively.

BRIEF DESCRIPTION OF THE DRAWINGS

Features will become apparent to those of skill in the art by describing in detail exemplary embodiments with reference to the attached drawings in which.

DETAILED DESCRIPTION

Exemplary embodiments will be described more fully hereinafter with reference to the accompanying drawings, in which various embodiments are shown.

Figure 1:
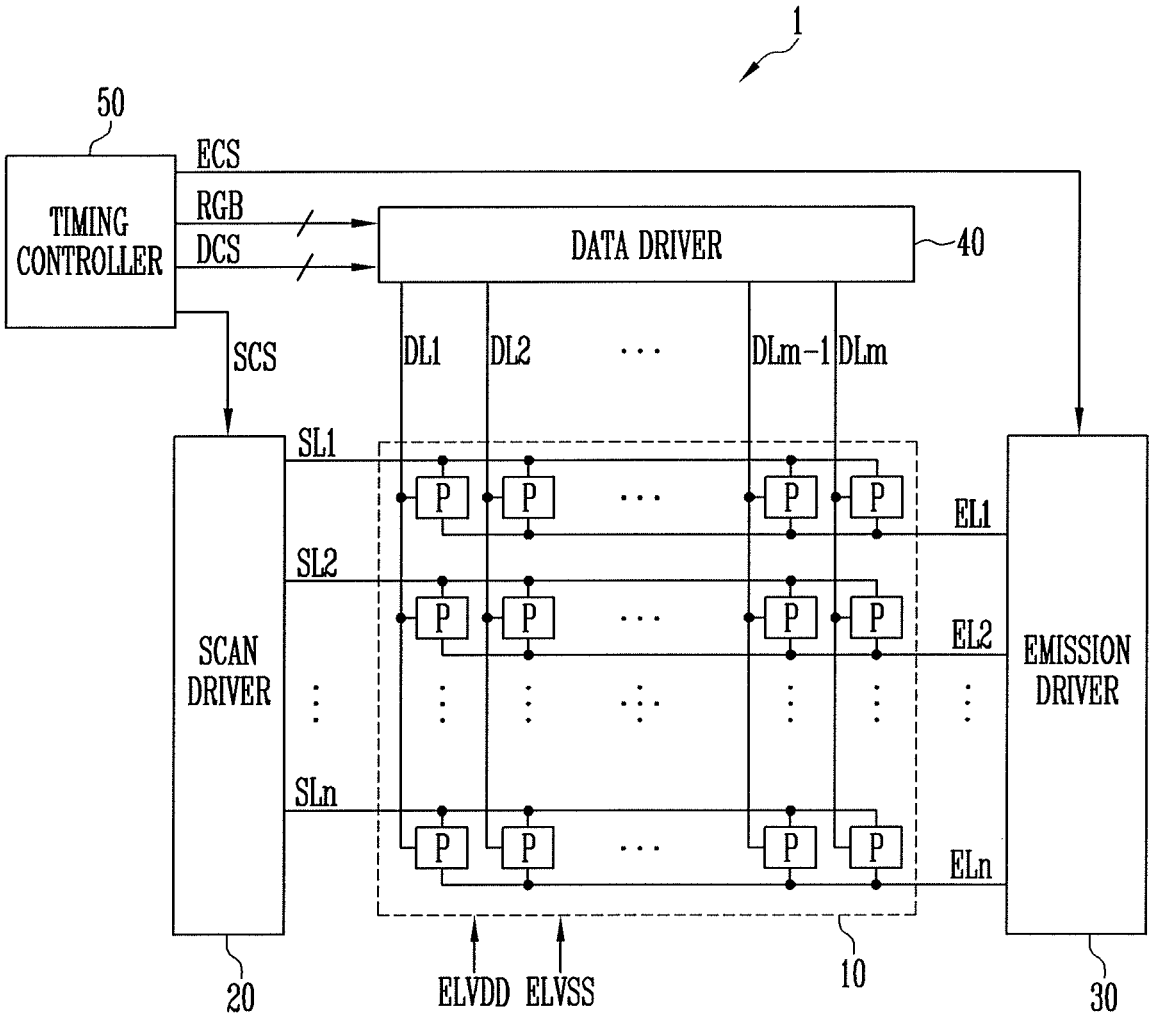
FIG. 1 illustrates a block diagram of an organic light emitting display device according to example embodiments.

FIG. 1 is a block diagram of an organic light emitting display device according to example embodiments. Referring to FIG. 1, the organic light emitting display device 1 may include a display panel 10, a scan driver 20, an emission driver 30, a data driver 40, and a timing controller 50.

The display panel 10 displays an image. The display panel 10 may include a plurality of scan lines SL1 to SLn, a plurality of emission control lines EL1 to ELn, a plurality of data lines DL1 to DLm, and a plurality of pixels P connected to the scan lines SL1 to SLn, the emission control lines EL1 to ELn, and the data lines DL1 to DLm, respectively. In some embodiments, the number of the scan lines SL1 to SLn and the number of the emission control lines EL1 to ELn may be n and the number of data lines DL1 to DLm may be m, where n and m are natural numbers. Accordingly, the number of pixels P may be n×m. The display panel 10 may receive a first driving power ELVDD and a second driving power ELVSS from the outside (e.g., a power supply).

The timing controller 50 may receive an input control signal and an input image signal from an image source, e.g., an external graphic device. The timing controller 50 may generate a data signal RGB corresponding to an operation condition of the display panel 10 based on the input image signal and may supply the data signal RGB to the data driver 40. The timing controller 50 may generate a scan driving control signal SCS for controlling the scan driver 20, an emission driving control signal ECS for controlling the emission driver 30, and a data driving control signal DCS for controlling the data driver 40. The timing controller 50 may supply the scan driving control signal SCS to the scan driver 20, the emission driving control signal ECS to the emission driver 30, and the data driving control signal DCS to the data driver 40.

A scan start pulse and clock signals may be included in the scan driving control signal SCS. The scan start pulse may control a first timing of the scan signal. The clock signals may be used to shift the scan start pulse.

The emission driving control signal ECS may include an emission control start pulse and clock signals. The emission control start pulse may control a first timing of the emission control signal. The clock signals may be used to shift the emission control start pulse. The emission driver 30 may receive the emission driving control signal ECS from the timing controller 50. The emission driver 30 may supply the emission control signal to the emission control lines EL1 to ELn in response to the emission driving control signal ECS. The emission control signal may control an emission time of the pixels P.

The data driving control signal DCS may include a source start pulse and clock signals. The source start pulse may control a sampling start point of the data. The clock signals may be used to control the sampling operation. The data driver 40 may receive the data driving control signal DCS from the timing controller 50. The data driver 40 may supply an analog data signal (data voltage) to the data lines DL1 to DLm in response to the data driving control signal DCS. The data signals supplied to the data lines DL1 to DLm may be supplied to the pixels P selected by the scan signal.

The scan driver 20 may receive the scan driving control signal SCS from the timing controller 50. The scan driver 20 may supply the scan signal to the scan lines SL1 to SLn in response to the scan driving control signal SCS.

Figure 2:
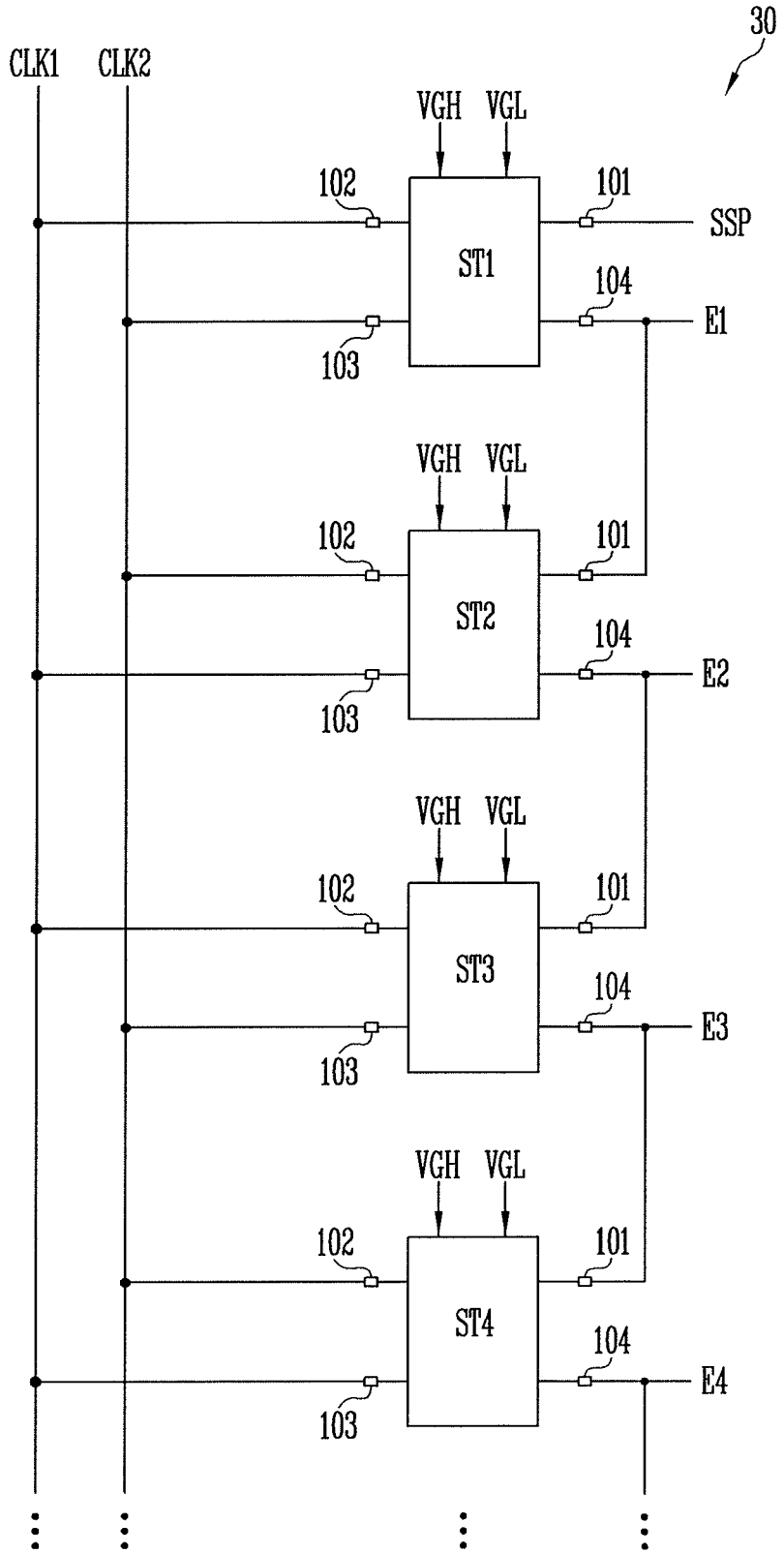
FIG. 2 illustrates a block diagram of an emission driver according to example embodiments.

FIG. 2 is a block diagram of an emission driver according to example embodiments. In FIG. 2, four stages are shown for convenience of description.

Referring to FIG. 2, the emission driver 30 may include a plurality of stages ST1 to ST4. For example, the first to fourth stages ST1 to ST4 may be connected to the first to fourth emission control lines, respectively. The first to fourth stages ST1 to ST4 may output the emission control signals E1 to E4 in response to clock signals CLK1 and CLK2. The stages ST1 to ST4 may have substantially the same circuit.

Each of the stages ST1 to ST4 may include a first input terminal 101, a second input terminal 102, a third input terminal 103, and an output terminal 104.

The first input terminal 101 may receive an output signal of a previous stage (i.e., the emission control signal of the previous stage) or a start pulse SSP. For example, the first input terminal 101 of the first stage ST1 may receive the start pulse SSP, and the first input terminal 101 of the second stage ST2 may receive the emission control signal E1 output from the first stage ST1.

The second input terminal 102 of a j-th stage may receive a first clock signal CLK1 and the third input terminal 103 of the j-th stage may receive a second clock signal CLK2, where j is a natural number. On the other hand, the second input terminal 102 of a (j+1)-th stage may receive the second clock signal CLK2 and the third input terminal 103 of the (j+1)-th stage may receive the first clock signal CLK1.

The first clock signal CLK1 and the second clock signal CLK2 have the same period and do not overlap with each other in phase. For example, the second clock signal CLK2 may be set to a signal shifted by half a period from the first clock signal CLK1.

In addition, the stages ST1 to ST4 may receive a voltage of a first power source VGL and a voltage of a second power source VGH. The voltage of the first power source VGL and the voltage of the second power source VGH may have DC voltage levels, respectively.

The voltage of the first power source VGL may be set to a gate-on voltage, and the voltage of the second power source VGH may be set to a gate-off voltage. For example, when the pixel P and the emission driver 30 are composed of P-channel metal oxide semiconductor (PMOS) transistors, the first power source VGL may correspond to a logic low level and the second power source VGH may correspond to a logic high level. Alternatively, the voltage of the first power source VGL and the voltage of the second power source VGH may be set depending on the type of the transistor, the use environment of the organic light emitting display device 1, and the like.

When the organic light emitting display device 1 is applied to an in-vehicle display, a transparent display of a vehicle window, etc., a large voltage difference between voltages of the first power source VGL and the second power source VGH is required to cope with very bright external light conditions and high temperature. For example, a voltage of the first power source VGL may be about −13V and a voltage of the second power source VGH may be about 8V, such that the voltage difference between the first power source VGL and the second power source VGH may be about 21V. However, when the display driving based on the high voltage level of the second power source VGH and the large voltage difference between the first power source VGL and the second power source VGH lasts for a long time, performance of transistors in the stages may deteriorate.

Figure 3:
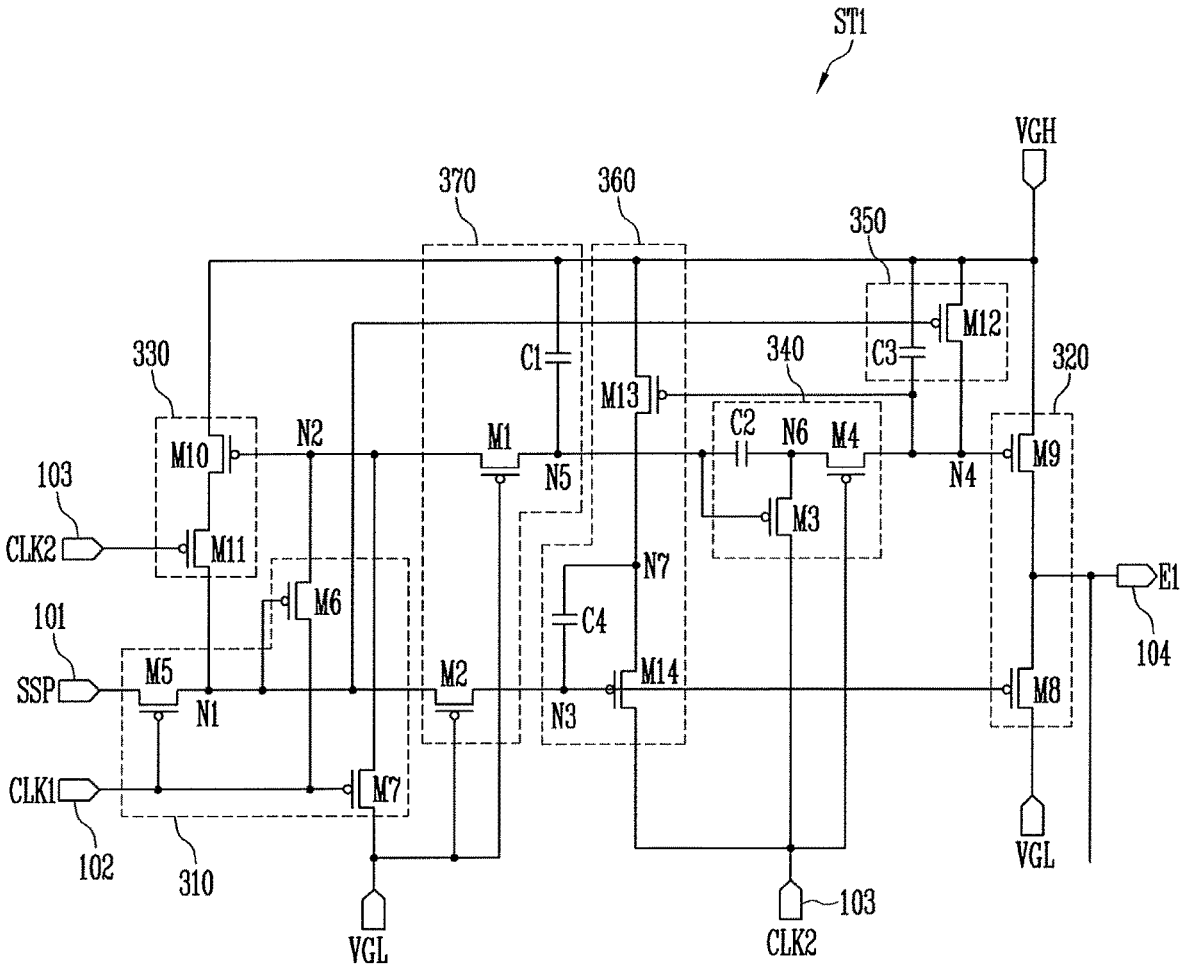
FIG. 3 illustrates a circuit diagram of an example of a stage included in the emission driver of FIG. 2.

FIG. 3 is a circuit diagram illustrating an example of a stage included in the emission driver of FIG. 2. Referring to FIGS. 1 to 3, the first stage ST1 may include an input block 310, an output block 320, a first signal processing block 330, a second signal processing block 340, a third signal processing block 350, a fourth signal processing block 360, and a stabilization block 370.

The input block 310 may supply a signal supplied to the first input terminal 101 (e.g., the start pulse SSP) to a first node N1 and control a voltage of a second node N2, in response to a signal supplied to the second input terminal 102 (e.g., the first clock signal CLK1). In some embodiments, the input block 310 may include a fifth transistor M5, a sixth transistor M6, and a seventh transistor M7.

The fifth transistor M5 may be connected between the first input terminal 101 and the first node N1. The fifth transistor M5 may include a gate electrode connected to the second input terminal 102. The fifth transistor M5 may be turned on to electrically connect the first input terminal 101 and the first node N1 when the first clock signal CLK1 has the gate-on voltage.

The sixth transistor M6 may be connected between the second input terminal 102 and the second node N2. The sixth transistor M6 may include a gate electrode connected to the first node N1. The sixth transistor M6 may be turned on or turned off in response to the voltage of the first node N1.

The seventh transistor M7 may be connected between the first power source VGL and the second node N2. A gate electrode of the seventh transistor M7 may be connected to the second input terminal 102. The seventh transistor M7 may be turned on to supply the voltage of the first power source VGL to the second node N2 when the first clock signal CLK1 is supplied to the second input terminal 102.

The output block 320 may output the voltage of the first power source VGL or the voltage of the second power source VGH to the output terminal 104 in response to a voltage of a third node N3 and a voltage of a fourth node N4. The voltage of the first power source VGL may correspond to the gate-on voltage level of the emission control signal E1 and the voltage of the second power source VGH may correspond to the gate-off voltage level of the emission control signal E1.

In some embodiments, the output block 320 may include an eighth transistor M8 and a ninth transistor M9. The eighth transistor M8 may be connected between the first power source VGL and the output terminal 104. A gate electrode of the eighth transistor M8 may be connected to the third node N3. The eighth transistor M8 may be turned on or turned off in response to the voltage of the third node N3. When the eighth transistor M8 is turned on, the first emission control signal E1 output from the output terminal 104 may have the gate-on voltage and the pixel P may emit light.

The ninth transistor M9 may be connected between the second power source VGH and the output terminal 104. A gate electrode of the ninth transistor M9 may be connected to the fourth node N4. The ninth transistor M9 may be turned on or turned off in response to the voltage of the fourth node N4. When the ninth transistor M9 is turned on, the first emission control signal E1 output from the output terminal 104 may have the gate-off level and the pixel P is in a non-emission state.

The first signal processing block 330 may control the voltage of the first node N1 in response to the voltage of the second node N2 and the signal supplied to the third input terminal 103. For example, when the voltage of the second node N2 has the gate-on level, the first signal processing block 330 may maintain the voltage of the first node N1 at the voltage of the second power source VGH, i.e., the gate-off voltage. The first signal processing block 330 may include a tenth transistor M10 and an eleventh transistor M11 connected in series between the second power source VGH and the first node N1.

A gate electrode of the tenth transistor M10 may be connected to the second node N2. The tenth transistor M10 may be turned on or turned off in response to the voltage of the second node N2.

A gate electrode of the eleventh transistor M11 may be connected to the third input terminal 103. The eleventh transistor M11 may be turned on in response to the gate-on voltage of the second clock signal CLK2.

The second signal processing block 340 may be connected to a fifth node N5 that electrically connects the second node N2 and the fourth node N4. The second signal processing block 340 may control a voltage of the fourth node N4 based on the second clock signal CLK2 supplied to the third input terminal 103 and the voltage of the fifth node N5. For example, when the voltage of the second node N2 has the gate-off level, the second signal processing block 340 may cause the ninth transistor M9 to be completely turned off by making the voltage of the fourth node N4 stably have the gate-off level.

In some embodiments, the second signal processing block 340 may include a third transistor M3, a fourth transistor M4, and a second capacitor C2. The second capacitor C2 may be connected between the fifth node N5 and a sixth node N6.

The third transistor M3 may be connected between the third input terminal 103 and the sixth node N6. A gate electrode of the third transistor M3 may be connected to the fifth node N5. The third transistor M3 may be turned on or turned off in response to the voltage of the fifth node N5.

The fourth transistor M4 may be connected between the sixth node N6 and the fourth node N4. A gate electrode of the fourth transistor M4 may be connected to the third input terminal 103. The fourth transistor M4 may be turned on in response to the gate-on level of the second clock signal CLK2 supplied to the third input terminal 103. Accordingly, one end of the second capacitor (i.e., the sixth node N6) and the fourth node N4 can be electrically connected. At this time, even if the third and fourth transistors M3 and M4 are switched by the second clock signal CLK2, the voltage of the fourth node N4 may be maintained without large fluctuation by the capacitor C2 charged with the voltage of the fifth node N5 (or the second node N2). For example, the voltage of the fourth node N4 may have a voltage level substantially same to that of the second node N2 or the fifth node N5.

The third signal processing block 350 may control the voltage of the fourth node N4 in response to the voltage of the first node N1. For example, when the first node N1 has the gate-on voltage, the third signal processing block 350 may cause the ninth transistor M9 of the output block 320 to be completely turned off by making the voltage of the fourth node N4 stably have the gate-off level. In some embodiments, the third signal processing block 350 may include a twelfth transistor M12 and a third capacitor C3.

The twelfth transistor M12 may be connected between the second power source VGH and the fourth node N4. A gate electrode of the twelfth transistor M12 may be connected to the first node N1. The twelfth transistor M12 may be turned on or turned off in response to the voltage of the first node N1. For example, when the eighth transistor M8 is turned on by the voltage of the first node N1, the twelfth transistor M12 may be turned on and the voltage of the second power source VGH may be supplied to the fourth node N4.

The third capacitor C3 may be connected between the second power source VGH and the fourth node N4. The third capacitor C3 may charge the voltage supplied to the fourth node N4 and may stably maintain the voltage of the fourth node N4.

The fourth signal processing block 360 may control the voltage of the third node N3 in response to the voltage of the fourth node N4. For example, when the fourth node N4 has the gate-on voltage, the fourth signal processing block 360 may cause the eighth transistor M8 of the output block 320 to be completely turned off by making the voltage of the third node N3 stably have the gate-off level. In some embodiments, the third signal processing block 350 may include a thirteenth transistor M13, a fourteenth transistor M14, and a fourth capacitor C4.

The thirteenth transistor M13 may be connected between the second power source VGH and a seventh node N7. A gate electrode of the thirteenth transistor M13 may be connected to the fourth node. The thirteenth transistor M13 may be turned on or turned off in response to the voltage of the fourth node N4.

The fourteenth transistor M14 may be connected between the seventh node N7 and the third input terminal. A gate electrode of the fourteenth transistor M14 may be connected to the third node N3. The fourteenth transistor M14 may be turned on or turned off in response to the voltage of the third node N3.

The fourth capacitor C4 may be connected between the seventh node N7 and the third node N3. The fourth capacitor C4 may charge the voltage supplied to the third node N3 and stably maintain the voltage of the third node N3.

The stabilization block 370 may be electrically connected between the input block 310 and the output block 320. The stabilization block 370 may limit (control) a voltage drop between the first node N1 and the third node N3, and a voltage drop between the second node N2 and the fourth node N4. In some embodiments, the stabilization block 370 may limit the voltage drop between the second node N2 and the fourth node N4 by lowering the voltage of the fifth node N5 to less than the voltage of the second power source VGH. In some embodiments, the stabilization block 370 may include a first transistor M1, a second transistor M2, and a first capacitor C1.

The second transistor M2 may be connected between the first node N1 and the third node N3. A gate electrode of the second transistor M2 may be connected to the first power source VGL. Therefore, the second transistor M2 is always in a turn-on state. The second transistor M2 may prevent a line voltage drop between the first node N1 and the third node N3. Therefore, the gate-on voltage (logic low level) of the emission control signal E1 may be stably output.

The first transistor M1 may be connected between the second node N2 and the fifth node N5. A gate electrode of the first transistor M1 may be connected to the first power source VGL. Accordingly, the first transistor M1 is always in the turn-on state. The first transistor M1 may prevent a line voltage drop between the second node N2 and the fifth node N5 (to the fourth node N4).

However, as described above, when the display driving by the high voltage level of the second high power source VGH and the large voltage difference between the first power source VGL and the second power source VGH lasts for a long time, an ion characteristic of the first transistor M1 may rapidly deteriorate. For example, a bias of a drain-source voltage of the first transistor M1 may be excessively increased by supplying the voltage of the second power source VGH to the first transistor M1 through the fifth node N5. Thereby, a threshold voltage of the first transistor M1 is shifted, which causes a change in the voltage of the fourth node N4 (i.e., the gate-on/gate-off voltages for the ninth transistor M9).

Also, the operation of the ninth transistor M9 and the gate-off voltage output of the emission control signal E1 may become unstable due to the voltage fluctuation of the fourth node N4. This may cause a false emission of the pixel P and an unintended white block image display.

In order to solve such a problem, the bias of the drain-source voltage of the first transistor M1 may drop below a certain level by adding the first capacitor C1. In particular, the first capacitor C1 may be connected between the second power source VGH and the fifth node N5. When the first capacitor C1 and the second capacitor C2 are electrically connected in parallel, the first capacitor C1 may function together with the second capacitor C2 to divide the DC voltage of the second power source VGH. That is, the voltage division for the second power source VGH may occur according to a capacitance ratio between the first capacitor C1 and the second capacitor C2. Accordingly, a voltage lower than the second power source VGH may be supplied to the first transistor M1, and the bias of the drain-source voltage of the first transistor M1 may be reduced to prevent the characteristic change of the first transistor M1.

The bias of the drain-source voltage of the first transistor M1 may be reduced to an optimum value by adjusting the capacitance ratio between the first capacitor C1 and the second capacitor C2, and the deterioration of the transistors and the threshold voltage change may be prevented. Therefore, the gate-off voltage of the emission control signal E1 can be stably output even if the organic light emitting display device 1 is exposed to the external environment at a high temperature and a high illuminance for a long time. That is, unintended pixel emission (for example, white block image) may be prevented by the stable emission control signal E1 output in the high-temperature and/or high-illuminance environment. Thus, driving reliability of the organic light emitting display device 1 may be ensured.

Figure 4:
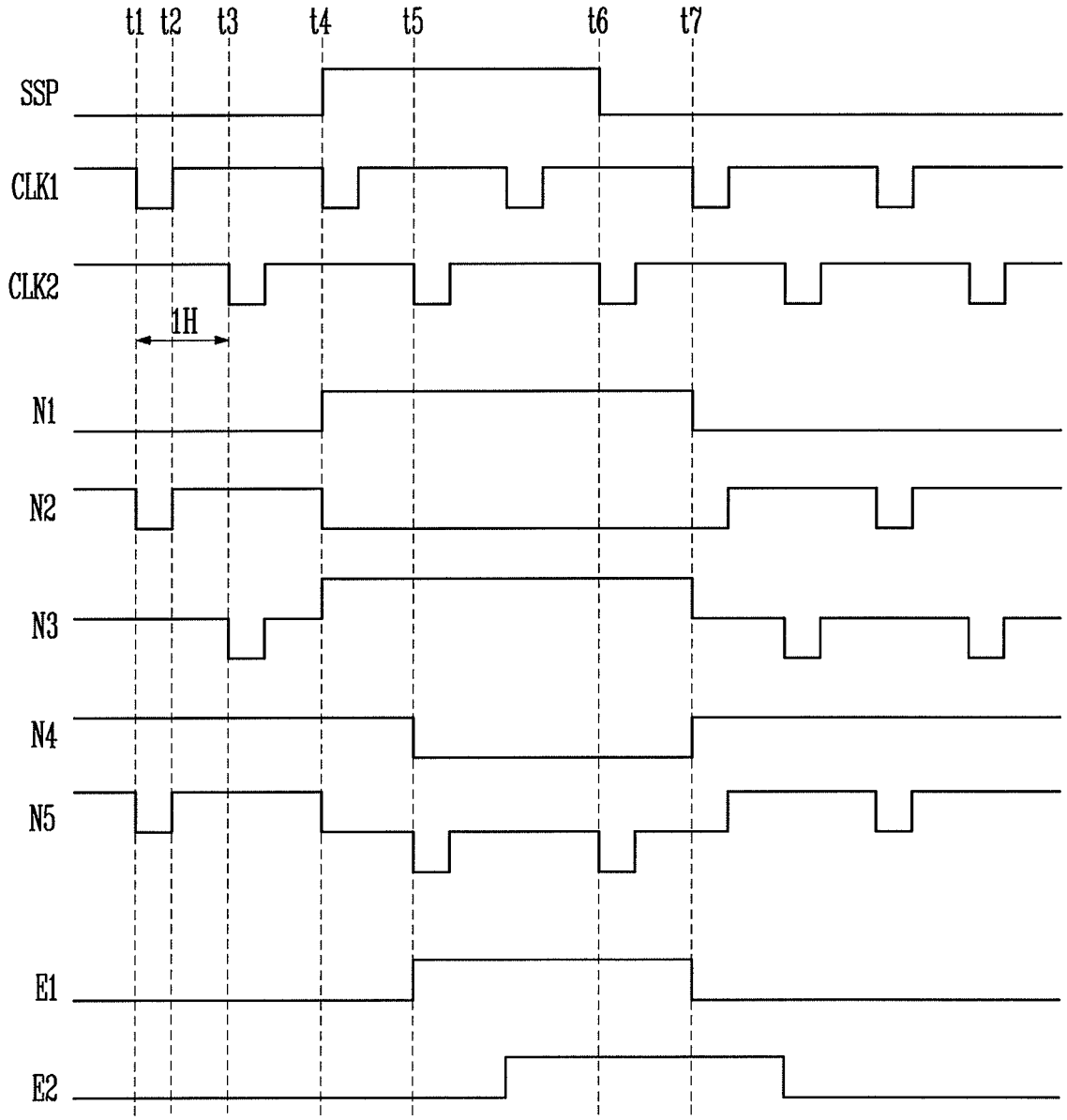
FIG. 4 illustrates a timing diagram of an example of an operation of the stage of FIG. 3.

FIG. 4 is a timing diagram illustrating an example of an operation of the stage of FIG. 3. Referring to FIGS. 3 and 4, the first clock signal CLK1 and the second clock signal CLK2 may have period of two horizontal periods 2H. The first clock signal CLK1 and the second clock signal CLK2 may be supplied in different horizontal periods. In other words, the second clock signal CLK2 may be set to a signal shifted by half a period (i.e., one horizontal period 1H) from the first clock signal CLK1.

The logic high level (high voltage) of the start pulse SSP may correspond to the voltage of the second power source VGH and the logic low level (low voltage) of the start pulse SSP may correspond to the voltage of the first power source VGL.

The voltage of the first power source VGL may be supplied to the second input terminal 102 and the third input terminal 103 when the clock signals CLK1 and CLK2 are supplied. The voltage of the second power source VGH may be supplied to the second input terminal 102 and the third input terminal 103 when the clock signals CLK1 and CLK2 are not supplied. Herein, a clock signal is considered supplied when having a low level and not supplied when having a high level.

At a first time point t1, the first clock signal CLK1 may be supplied to the second input terminal 102, and the fifth transistor M5 and the seventh transistor M7 may be turned on. When the fifth transistor M5 is turned on, the first input terminal 101 and the first node N1 may be electrically connected. Here, since the second transistor M2 maintains the turn-on state, the first input terminal 101 may be also electrically connected to the third node N3 via the first node N1. When the seventh transistor M7 is turned on, the voltage of the first power source VGL may be supplied to the second node N2 and the fifth node N5. Here, the first clock signal CLK1 may have the voltage of the first power source VGL, so that the second node N2 and the fifth node N5 may stably have the voltage of the first power source VGL.

The logic low level voltage (e.g., VGL, hereinafter, a low voltage) may be supplied to the first node N1 and the third node N3 at the first time point t1. Accordingly, the sixth transistor M6, the eighth transistor M8, and the twelfth transistor M12 may be turned on.

When the twelfth transistor M12 is turned on, the voltage of the second power source VGH is supplied to the fourth node N4, so that the ninth transistor M9 may be turned off. At this time, a voltage corresponding to the turn-off of the ninth transistor M9 may be charged in the third capacitor C3.

When the eighth transistor M8 is turned on, the voltage of the first power source VGL may be supplied to the output terminal 104. Therefore, at the first time point t1, the first emission control signal E1 may have the gate-on voltage.

When the sixth transistor M6 is turned on, the first clock signal CLK1 may be supplied to the second node N2. The first clock signal CLK1 may also be supplied to the fifth node N5 via the second node N2.

The third transistor M3 may be turned on when the second node N2 and the fifth node N5 have the voltage of the first power source VGL. When the third transistor M3 is turned on, the logic high level voltage (for example, VGH) from the third input terminal 103 may be supplied to one end of the second capacitor C2 (i.e., the sixth node N6). At this time, since the fourth transistor M4 is in the turn-off state, the voltage of the fourth node N4 may maintain the voltage of the second power source VGH regardless of the voltage of the fifth node N5 and the voltage of the sixth node N6.

The thirteenth transistor M13 may maintain the turn-off state by the voltage of the fourth node N4, and the seventh node N7 may be floated. Therefore, the voltages of the first and third nodes N1 and N3 may maintain the low voltage.

At a second time point t2, the supply of the first clock signal CLK1 to the second input terminal 102 may be stopped. Accordingly, the fifth transistor M5 and the seventh transistor M7 may be turned off. At this time, the fourth node N4 and the third node N3 may maintain the voltage of a previous period by the third and fourth capacitors C3 and C4. When the third node N3 maintains the low voltage, the sixth transistor. M6, the eighth transistor M8, and the twelfth transistor M12 may be maintained in a turn-on state.

The high voltage (the logic high level voltage) from the second input terminal 102 may be supplied to the second node N2 and the fifth node N5 by the turn-on state of the sixth transistor M6. Also, the thirteenth transistor M13 and the third transistor M3 may be turned off by the turn-on state of the sixth transistor M6.

At the third time point t3, the second clock signal CLK2 may be supplied to the third input terminal 103 and the fourth transistor M4 and the eleventh transistor M11 may be turned on.

When the fourth transistor M4 is turned on, the sixth node N6 and the fourth node N4 may be electrically connected. At this time, the fourth node N4 may maintain the voltage of the second power source VGH.

In addition, when the second clock signal CLK2 is supplied to the third input terminal 103, the voltage of the third node N3 may be dropped to a voltage less than the first power source VGL by a coupling of the fourth capacitor C4. Then, the voltage applied to the gate electrodes of the eighth transistor M8 and the twelfth transistor M12 may be less than the voltage of the first power source VGL so that the driving characteristics of the transistors M8 and M12 may be improved.

The first node N1 substantially maintains the voltage of the first power source VGL by the second transistor M2 regardless of the voltage drop at the third node N3. In other words, since the voltage of the first power source VGL is applied to the gate electrode of the second transistor M2, the voltage of the first node N1 may maintain the voltage of the first power source VGL regardless of the voltage drop at the third node N3. Accordingly, a bias of a drain-source voltage of the fifth transistor M5 may be decreased, and thus the characteristic change of the fifth transistor M5 may be prevented.

At a fourth time point t4, the high voltage of the start pulse SSP may be supplied to the first input terminal 101 and the first clock signal CLK1 may be supplied to the second input terminal 102. The fifth transistor M5 and the seventh transistor M7 may be turned on by the first clock signal CLK1.

When the fifth transistor M5 is turned on, the first node N1 and the third node N3 may have the high voltage. The sixth transistor M6, the eighth transistor M8, and the twelfth transistor M12 may be turned off by the high voltage of the first node N1 and the high voltage of the third node N3.

When the seventh transistor M7 is turned on, the tenth transistor M10 and the third transistor M3 may be turned on. At this time, even though the tenth transistor M10 is turned on, the voltage of the first node N1 does not change because the eleventh transistor M11 is in the turn-off state.

When the third transistor M3 is turned on, the sixth node N6 and the third input terminal 103 may be electrically connected. At this time, since the fourth transistor M4 is in the turn-off state, the voltage of the fourth node N4 may maintain the high voltage.

At a fifth time point t5, the second clock signal CLK2 may be supplied to the second input terminal 103. The eleventh transistor M11 and the fourth transistor M4 may be turned on by the second clock signal CLK2. Since the voltage of the second node N2 and the voltage of the fifth node N5 are set to the voltage of the first power source VGL at the fifth time point t5, the tenth transistor M10 and the third transistor M3 may maintain the turned-on state.

When the fourth transistor M4 and the third transistor M3 are turned on, the second clock signal CLK2 may be supplied to the fourth node N4 and the ninth transistor M9 may be turned on. When the ninth transistor M9 is turned on, the voltage of the second power source VGH may be supplied to the output terminal 104. The voltage of the second power source VGH supplied to the output terminal 104 may correspond to the gate-off voltage of the emission control signal E1.

When the tenth transistor M10 and the eleventh transistor M11 are turned on, the voltage of the second power source VGH may be supplied to the first node N1 and the third node N3. Therefore, the sixth transistor M6 and the eighth transistor M8 can stably maintain the turn-off state.

When the second clock signal CLK2 is supplied to one end of the second capacitor C2, the voltage of the fifth node N5 may be dropped lower than the voltage of the first power source VGL by the coupling of the second capacitor C2. Then, the voltage applied to the gate electrode of the third transistor M3 may become lower than the voltage of the first power source VGL, so that the driving characteristic of the third transistor M3 may be improved.

In addition, the voltage of the second node N2 may substantially maintain the voltage of the first power source VGL by the first transistor M1 regardless of the voltage of the fifth node N5. In other words, since the voltage of the first power source VGL is applied to the gate electrode of the first transistor M1, the voltage of the second node N2 may maintain the voltage of the first power source VGL. In this case, a drain-source bias of the sixth transistor M6 may be decreased and, thus, the characteristic change of the sixth transistor M6 may be reduced or prevented.

However, as described above, the voltage of the fifth node N5 may become excessively high due to the high voltage level of the second power source VGH. Thus, the drain-source bias of the first transistor M1 may increase. When the high drain-source bias of the first transistor M1 is maintained, the first transistor M1 may rapidly deteriorate.

To solve this problem, the stage ST1 may additionally include the first capacitor C1. When the second node N2 and the fourth node N4 have the high voltage and the first node has the low voltage, the first capacitor C1 and the second capacitor C2 may be connected substantially in parallel with respect to the second power source VGH. Accordingly, the first capacitor C1 and the second capacitor C2 may divide the DC voltage of the second power source VGH, so that the voltage of the fifth node N5 may be lower than a predetermined voltage level. Therefore, the bias of the drain-source voltage of the first transistor M1 may be decreased to a certain level or lower, and the detioration of the first transistor M1 can be reduced or prevented.

At a sixth time point t6, the low voltage of the start pulse SSP may be supplied to the first input terminal 101 and the second clock signal CLK2 may be supplied to the third input terminal 103. The eleventh transistor M11 and the fourth transistor M4 may be turned on by the second clock signal CLK2. Since the fifth transistor M5 has the turn-off state due to the first clock signal CLK1 having the high voltage at the sixth time point t6, the stage ST is not affected by the change in the start pulse SSP.

At the seventh time point t7, the first clock signal CLK1 may be supplied to the second input terminal 102 and the fifth transistor M5 and the seventh transistor M7 may be turned on. At this time, the start pulse SSP maintains the low voltage.

The low voltage from the first input terminal 101 may be supplied to the first node N1 and the third node N3 by the turn-on of the fifth transistor M5. Accordingly, the sixth transistor M6, the eighth transistor M8, and the twelfth transistor M12 may be turned on.

When the sixth transistor M6 is turned on, the first clock signal CLK1 may be supplied to the second node N2 and the fifth node N5. When the twelfth transistor M12 is turned on, the voltage of the second power source VGH may be supplied to the fourth node N4, so that the ninth transistor M9 may be turned off. The voltage of the first power source VGL may be supplied to the output terminal 104 by turning on the eighth transistor M8. The voltage of the first power source VGL supplied to the output terminal 104 may correspond to the gate-on voltage of the first emission control signal E1.

The stages according to example embodiments may sequentially output the emission control signals by repeating the above-described processes.

Figure 5:
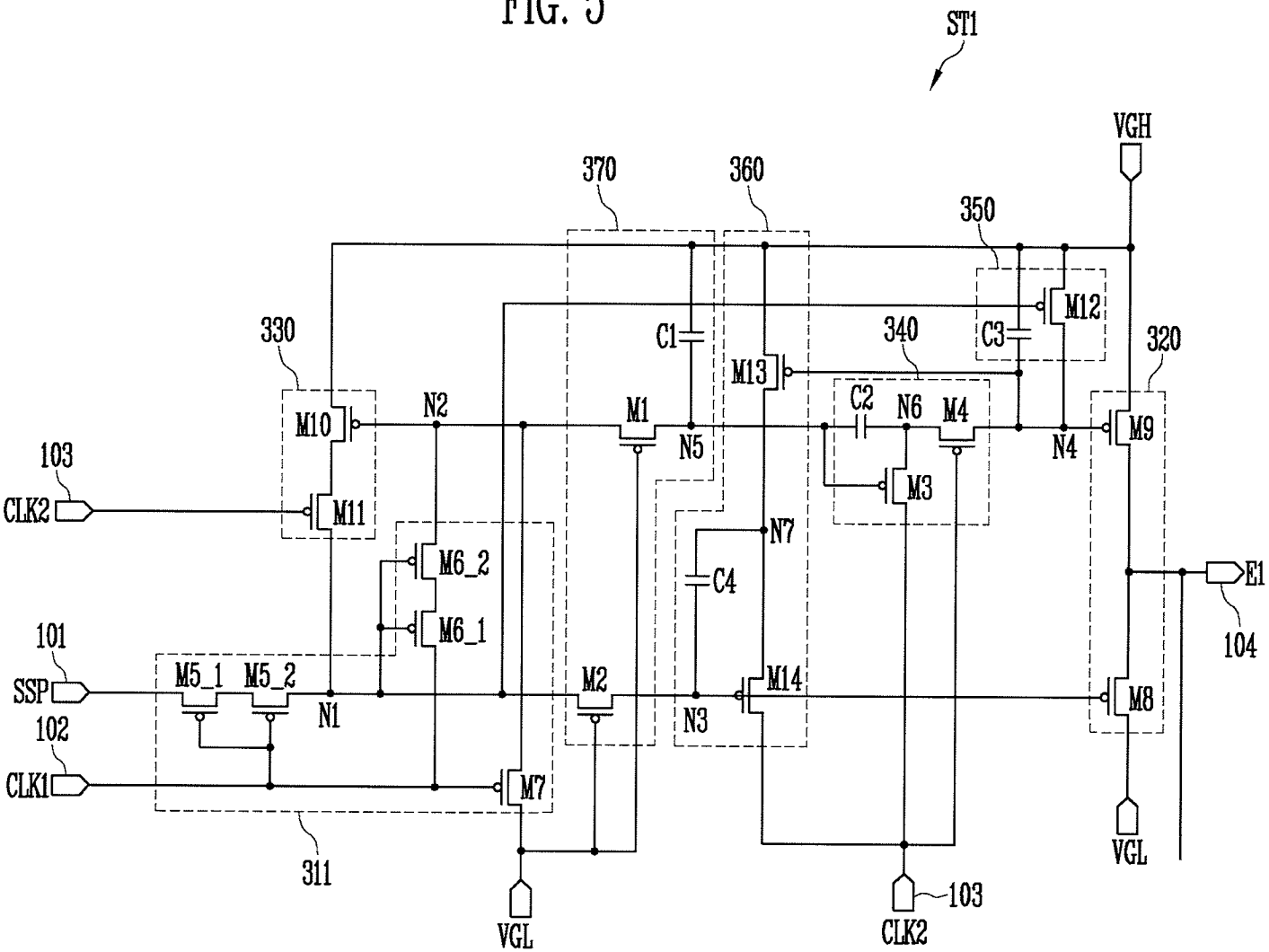
FIG. 5 illustrates a circuit diagram of an example of the stage of FIG. 3.

FIG. 5 is a circuit diagram illustrating an example of the stage of FIG. 3. In FIG. 5, like reference numerals are used to designate elements of the stage the same as those in FIG. 3, and detailed description of these elements may be omitted. The stage of FIG. 5 may be substantially the same as or similar to the stage of FIG. 3 except for the input block.

Referring to FIGS. 3 and 5, the first stage ST1 may include an input block 311, the output block 320, the first signal processing block 330, the second signal processing block 340, the third signal processing block 350, the fourth signal processing block 360, and the stabilization block 370.

The input block 311 may supply a signal supplied to the first input terminal 101 (e.g., the start pulse SSP) to the first node N1 and control the voltage of the second node N2, in response to a signal supplied to the second input terminal 102 (e.g., the first clock signal CLK1). In some embodiments, the input block 311 may include a plurality of fifth transistors M5_1 and M5_2, a plurality of sixth transistors M6_1 and M6_2, and the seventh transistor M7.

The fifth transistors M5_1 and M5_2 may be connected in series between the first input terminal 101 and the first node N1. Each of the fifth transistors M5_1 and M5_2 may include a gate electrode connected to the second input terminal 102. The fifth transistors M5_1 and M5_2 may be turned on to electrically connect the first input terminal 101 and the first node N1 when the first clock signal CLK1 has the gate-on voltage.

The sixth transistors M6_1 and M6_2 may be connected in series between the second input terminal 102 and the second node N2. Each of the sixth transistors M6_1 and M6_2 may include a gate electrode connected to the first node N1. The sixth transistors M6_1 and M6_2 may be turned on or turned off based on the voltage of the first node N1.

Since the emission driver of FIG. 5 is substantially the same as the emission driver of FIG. 3 except for the plurality of fifth and sixth transistors M5_1, M5_2, M6_1 and M6_2 in order to minimize the leakage current, duplicate descriptions will not be repeated.

Figure 6:
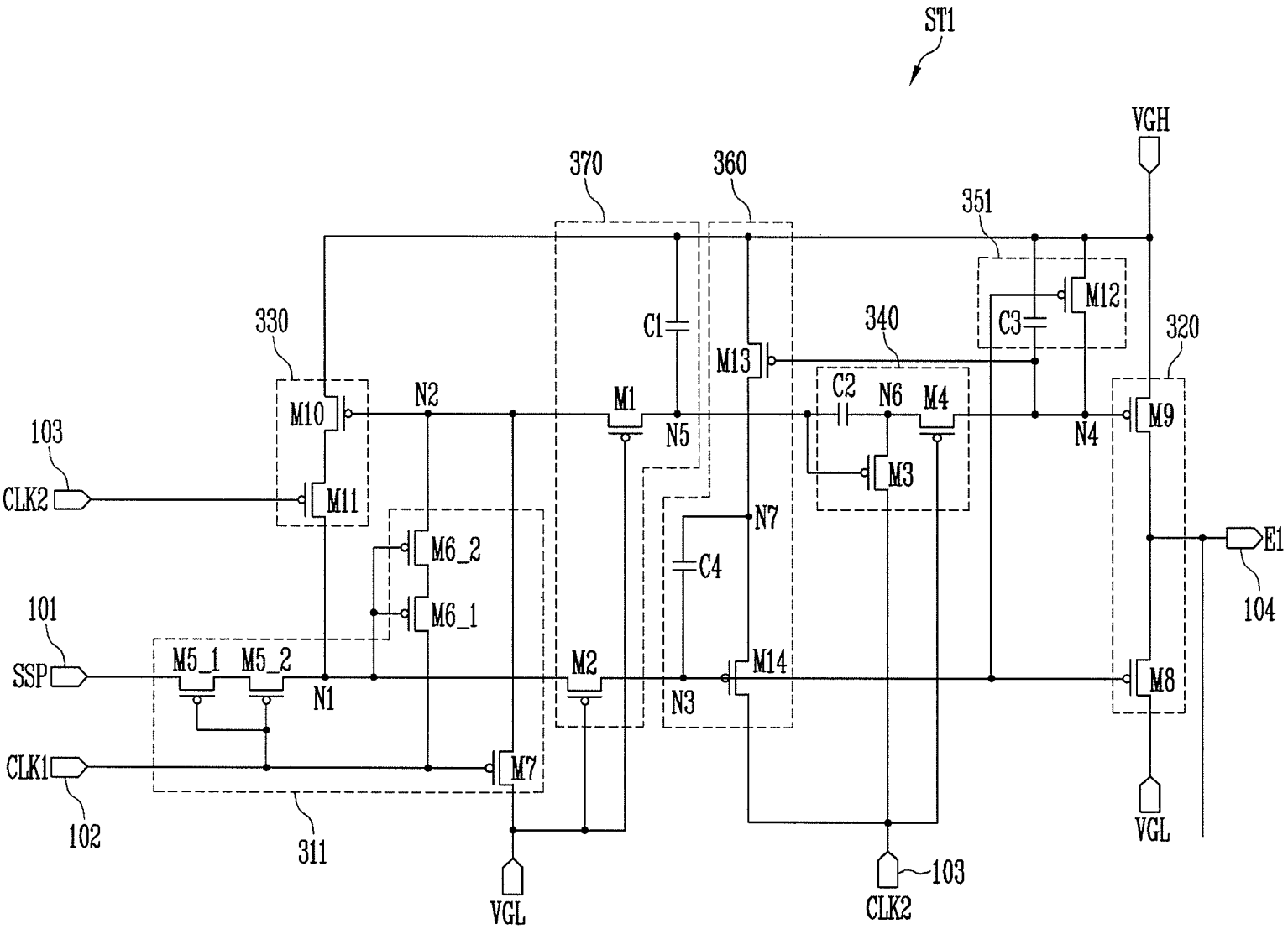
FIG. 6 illustrates a circuit diagram of another example of the stage of FIG. 3.

FIG. 6 is a circuit diagram illustrating another example of the stage of FIG. 3. In FIG. 6, like reference numerals are used to designate elements of the stage the same as those in FIGS. 3 and 5, and detailed description of these elements may be omitted. The stage of FIG. 6 may be substantially the same as or similar to the stage of FIG. 3 except for the third signal processing block.

Referring to FIGS. 3 and 6, the first stage ST1 may include the input block 311, the output block 320, the first signal processing block 330, the second signal processing block 340, a third signal processing block 351, the fourth signal processing block 360, and the stabilization block 370.

The third signal processing block 351 may control the voltage of the fourth node N4 in response to the voltage of the first node N1. For example, when the first node N1 has the gate-on voltage, the third signal processing block 351 may cause the ninth transistor M9 of the output block 320 to be completely turned off by making the voltage of the fourth node N4 stably have the gate-off level. In some embodiments, the third signal processing block 351 may include the twelfth transistor M12 and the third capacitor C3.

A gate electrode of the twelfth transistor M12 may be connected to the third node N3. The twelfth transistor M12 may be operated by the voltage of the third node N3. Since the twelfth transistor M12 is controlled substantially in synchronization with the eighth transistor M8 that controls the emission control signal output, the emission control signal output stability may be further improved.

As described above, the emission driver according to example embodiments may suppress an increase in the bias of the drain-source voltage of the first transistor M1 using the first capacitor C1 included in the stabilization block 370. Therefore, the change in characteristics of the transistors (particularly, the first transistor MD included in the stage of the emission driver may be suppressed, and the gate-off voltage of the emission control signal may be stably outputted even when the emission driver is exposed to the external environment at high temperature and high illuminance for a long time. Accordingly, the emission driver may be robust to an external environment of high temperature and/or high illuminance.

In addition, the organic light emitting display device according to example embodiment may include the emission driver to secure the stable output of the emission control signal. Thus, unintended light emission from the pixels (e.g., the white block image) in the high-temperature and/or the high-illuminance environment can be prevented, and driving reliability of the organic light emitting display device can be improved.

The present embodiments may be applied to any emission driver and display device including the emission driver. For example, the present embodiments may be applied to a transparent display device, an in-vehicle display, etc.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An emission driver, comprising:

a plurality of stages each outputting an emission control signal, wherein a k-th stage (k is a natural number) includes:

an input block to supply a signal supplied to a first input terminal to a first node and to supply a voltage of a first power source to a second node, in response to a signal supplied to a second input terminal;

an output block to supply the voltage of the first power source or a voltage of a second power source to an output terminal in response to a voltage of a third node and a voltage of a fourth node;

a first signal processing block to control a voltage of the first node in response to a voltage of the second node and a signal supplied to a third input terminal;

a second signal processing block connected to a fifth node electrically connecting the second node and the fourth node, wherein the second signal processing block is to control the voltage of the fourth node in response to the signal supplied to the third input terminal and a voltage of the fifth node;

a third signal processing block to control the voltage of the fourth node in response to the voltage of the first node;

a fourth signal processing block to control the voltage of the third node in response to the voltage of the fourth node; and a stabilization block electrically connected between the input block and the output block to limit a voltage drop between the first node and the third node, wherein the stabilization block limits a voltage drop between the second node and the fourth node by lowering the voltage of the second power source supplied to the fifth node.

2. The emission driver as claimed in claim 1, wherein the stabilization block includes:

a first transistor connected between the second node and the fifth node, the first transistor including a gate electrode to receive the voltage of the first power source;

a second transistor connected between the first node and the third node, the second transistor including a gate electrode to receive the voltage of the first power source; and a first capacitor connected between the second power source and the fifth node.

3. The emission driver as claimed in claim 2, wherein the second signal processing block includes:

a third transistor connected between the third input terminal and a sixth node, the third transistor including a gate electrode connected to the fifth node;

a fourth transistor connected between the sixth node and fourth node, the fourth transistor including a gate electrode connected to the third input terminal; and a second capacitor connected between the fifth node and the sixth node.

4. The emission driver as claimed in claim 3, wherein a bias of a drain-source voltage of the first transistor is determined based on a capacitance ratio between the first capacitor and the second capacitor.

5. The emission driver as claimed in claim 2, wherein the first and second transistors are configured to maintain a turn-on state regardless of signals supplied to the first to third input terminals.

6. The emission driver as claimed in claim 2, wherein the input block includes:

a fifth transistor connected between the first input terminal and the first node, the fifth transistor including a gate electrode connected to the second input terminal;

a sixth transistor connected between the second input terminal and the second node, the sixth transistor including a gate electrode connected to the first node; and a seventh transistor connected between the first power source and the second node, the seventh transistor including a gate electrode connected to the second input terminal.

7. The emission driver as claimed in claim 2, wherein the output block includes:

an eighth transistor connected between the first power source and the output terminal, the eighth transistor including a gate electrode connected to the third node; and a ninth transistor connected between the second power source and the output terminal, the ninth transistor including a gate electrode connected to the fourth node.

8. The emission driver as claimed in claim 2, wherein the first signal processing block includes:

tenth and eleventh transistors connected in series between the second power source and the first node, wherein a gate electrode of the tenth transistor is connected to the second node, and a gate electrode of the eleventh transistor is connected to the third input terminal.

9. The emission driver as claimed in claim 2, wherein the third signal processing block includes:

a twelfth transistor connected between the second power source and the fourth node, the twelfth transistor including a gate electrode connected to the first node or the third node; and a third capacitor connected between the second power source and the fourth node.

10. The emission driver as claimed in claim 2, wherein the fourth signal processing block includes:

a thirteenth transistor connected between the second power source and a seventh node, the thirteenth transistor including a gate electrode connected to the fourth node;

a fourteenth transistor connected between the seventh node and the third input terminal, the fourteenth transistor including a gate electrode connected to the third node; and a fourth capacitor connected between the seventh node and the third node.

11. The emission driver as claimed in claim 1, wherein:

the voltage of the first power source corresponds to a gate-on voltage, and the voltage of the second power source corresponds to a gate-off voltage.

12. The emission driver as claimed in claim 1, wherein the first input terminal is configured to receive a start pulse or an output signal of a previous stage.

13. The emission driver as claimed in claim 1, wherein:

the second input terminal receives a first clock signal, and the third input terminal receives a second clock signal.

14. The emission driver as claimed in claim 13, wherein:

the first clock signal and the second clock signal have a same period, and the second clock signal is a signal shifted by half a period from the first clock signal.

15. An organic light emitting display device, comprising:

a display panel including a plurality of pixels;

a scan driver to supply a scan signal to the pixels through a plurality of scan lines;

a data driver to supply a data signal to the pixels through a plurality of data lines; and an emission driver to supply an emission control signal to the pixels through a plurality of emission control lines;

and a data driver to supply a data signal to the pixels through a plurality of data lines, wherein the emission driver includes:

a plurality of stages each outputting the emission control signal, wherein a k-th stage (k is a natural number) includes:

an input block to supply a signal supplied to a first input terminal to a first node and to supply a voltage of a first power source to a second node, in response to a signal supplied to a second input terminal;

an output block to supply the voltage of the first power source or a voltage of a second power source to an output terminal in response to a voltage of a third node and a voltage of a fourth node;

a first signal processing block to control a voltage of the first node in response to a voltage of the second node and a signal supplied to a third input terminal;

a second signal processing block connected to a fifth node electrically connecting the second node and the fourth node, wherein the second signal processing block is to control the voltage of the fourth node in response to the signal supplied to the third input terminal and a voltage of the fifth node;

a third signal processing block to control the voltage of the fourth node in response to the voltage of the first node;

a fourth signal processing block to control the voltage of the third node in response to the voltage of the fourth node; and a stabilization block electrically connected between the input block and the output block to limit a voltage drop between the first node and the third node, wherein the stabilization block limits a voltage drop between the second node and the fourth node by lowering the voltage of the second power source supplied to the fifth node.

16. The organic light emitting display device as claimed in claim 15, wherein the stabilization block includes:

a first transistor connected between the second node and the fifth node, the first transistor including a gate electrode to receive the voltage of the first power source;

a second transistor connected between the first node and the third node, the second transistor including a gate electrode to receive the voltage of the first power source; and a first capacitor connected between the second power source and the fifth node.

17. The organic light emitting display device as claimed in claim 16, wherein the second signal processing block includes:

a third transistor connected between the third input terminal and a sixth node, the third transistor including a gate electrode connected to the fifth node;

a fourth transistor connected between the sixth node and fourth node, the fourth transistor including a gate electrode connected to the third input terminal; and a second capacitor connected between the fifth node and the sixth node.

18. The organic light emitting display device as claimed in claim 17, wherein a bias of a drain-source voltage of the first transistor is determined based on a capacitance ratio between the first capacitor and the second capacitor.

19. The organic light emitting display device as claimed in claim 15, wherein the first input terminal is configured to receive a start pulse or an output signal of a previous stage.

20. The organic light emitting display device as claimed in claim 19, wherein the second input terminal and the third input terminal of a j-th stage are configured to receive a first clock signal and a second clock signal, respectively, wherein the second input terminal and the third input terminal of a (j+1)-th stage are configured to receive the second clock signal and the first clock signal, respectively, and wherein j is a natural number less than k.

* * * * *